US005642539A

United States Patent [19]

Kuo

[11] Patent Number: 5,642,539

[45] Date of Patent: Jul. 1, 1997

[54] MULTI-FUNCTION HEALTHFUL BED

[76] Inventor: Shang-Tai Kuo, No. 21 Lane 351 An Chung Road, Sec 6 Tainan, Taiwan

[21] Appl. No.: 562,136

[22] Filed: Nov. 22, 1995

[51] Int. Cl.[6] ..... A47C 21/04

[52] U.S. Cl. ..... 5/423; 5/284; 5/915; 5/933

[58] Field of Search ..... 5/109, 284, 421, 5/423, 469, 915, 933

[56] References Cited

U.S. PATENT DOCUMENTS

| | | | |
|---|---|---|---|
| 2,400,790 | 5/1946 | Tolen | 5/284 |
| 2,493,067 | 1/1950 | Goldsmith | 5/423 |
| 3,266,064 | 8/1966 | Figman | 5/284 |
| 3,928,876 | 12/1975 | Starr | 5/284 |
| 4,218,791 | 8/1980 | Itoku | 5/284 |
| 5,416,935 | 5/1995 | Nieh | 5/284 X |

*Primary Examiner*—Michael F. Trettel
*Attorney, Agent, or Firm*—Pro-Techtor International

[57] ABSTRACT

A multi-function healthful bed including a bed frame, a bottom bed board, an upper bed board, air valves, a blower, two mufflers, an eccentric motor, four elastic feet supporting four feet of the bed frame, four swayable rods placed on four corner feet of a support plate, a massage bar, an air percolating plate, and a pillow. Air valves fixed in the upper bed board allow air to flow from an air chamber around the body of a user. Warm or cool air may be circulated. The massage bar also includes air valves. The eccentric motor sways the entire bed frame.

1 Claim, 11 Drawing Sheets

MULTI-FUNCTION HEALTHFUL BED

BACKGROUND OF THE INVENTION

This invention concerns a multi-function healthful bed, and in particular, a bed that is able to supply warmth or coolness or humidity to the user as desired.

Most conventional beds are not able to be warmed or cooled in cold or hot weather. Water beds have merit for softness and coolness, and are suitable for hot weather, but in cold weather, the water in the bed has to be heated by an electric heater for a period of time. Otherwise, water beds are not suitable for sleeping on in cold weather.

SUMMARY OF THE INVENTION

This invention has been devised to offer a bed with various functions of supplying warmth, coolness or humidity to the bed to cool or warm the body of a user of this bed. In addition, a massage bar is included to be used for massaging the body of a user. Also, warm air can be made to flow out of the massage bat, if desired. Further, the whole bed can be swayed by an eccentric motor.

A general feature of the present invention is the provision of an air chamber formed with a bed frame, a bottom bed board and an upper bed board. The bed has an air tube provided with a heater to supply the air chamber with warm air. A blower sends the warmed air into the air chamber, and two mufflers reduce the noise of the blower. A massage bar is provided with air valves and is connected to a flexible tube connected to the air chamber to massage the body of a user lying on the bed.

A special feature of the bed of the present invention is a plurality of air valves particularly designed and fixed through upper small bed boards and upper small corner bed boards that form the upper bed board. The air valves are compressed to let air into the air chamber and to flow through up to surround the body of a user lying on the bed.

Another special feature of the bed of the present invention is a hole provided in the bottom bed board to connect with an air tube connected with an air conditioner in a house. Cooled air coming from the air conditioner can be directed into the air chamber, and flow through the air valves to surround the body of a user.

Another special feature of the bed of the present invention is the structure of the upper bed board, which includes a plurality of small bed boards and four corner bed boards on four lateral bars fixed in the bed frame on four longitudinal bars that are in turn fixed in the bed frame and on the bottom bed board. The four corner bed boards are useful for positioning the small bed boards.

One more special feature of the present invention is an eccentric motor mounted on a support plate with four corner feet. A swayable rod is placed on each of the four corner feet and under the bottom bed board so that the bottom bed board is swayed by operation of the eccentric motor.

BRIEF DESCRIPTION OF THE DRAWINGS

This invention will be better understood by reference to the accompanying drawings, wherein.

DESCRIPTION OF THE PREFERRED EMBODIMENT

Figure 1:
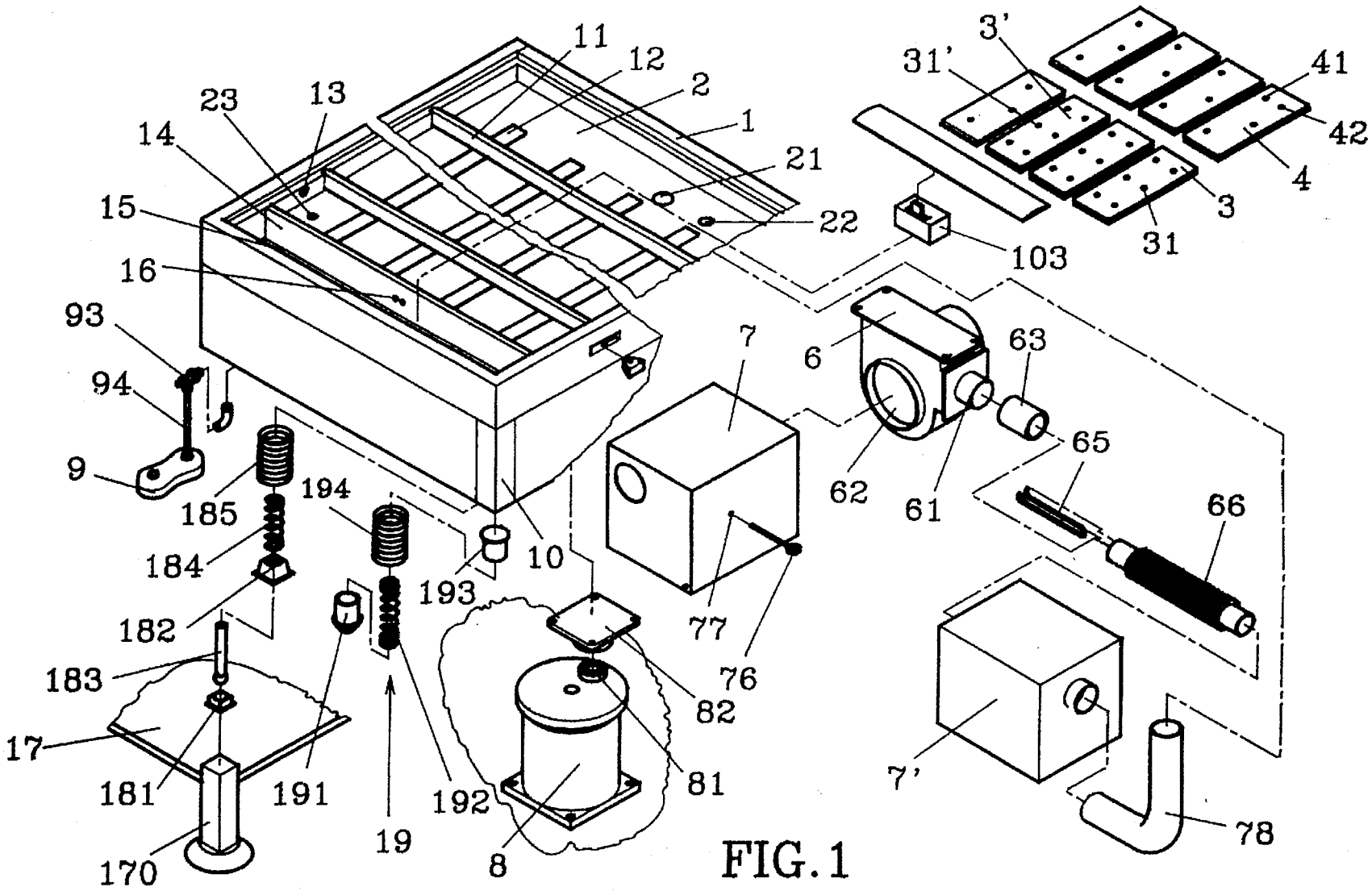
FIG. 1 is an exploded perspective view of a preferred embodiment of a multi-function healthful bed of the present invention.

A preferred embodiment of a multi-function healthful bed of the present invention, as shown in FIGS. 1–18, comprises a bed frame 1, a bottom bed board 2, an upper bed board 3 formed of a plurality of small bed boards 3' and four small corner bed boards 4, a plurality of air valves 5, a blower 6, two mufflers 7, an eccentric motor 8, four swayable rods, four elastic feet 19, a massage bar 9, an air percolating board 101, a pillow 102, and a foot swayer 103 as its main components.

The bed frame 1, as shown in FIGS. 1, 3, 12 and 13, is preferably shaped as a rectangle. The bed frame 1 is connected to the bottom bed board 2 along a bottom edge. In addition, there are four lower longitudinal bars 12 equidistantly spaced and surrounded by the bed frame body 1. Four upper lateral bars 11 are equidistantly spaced across the four lower longitudinal bars 12. A separating lateral elongate board 14 is positioned parallel to the four lateral bars 11 at one end of the four lower longitudinal bars 12 near a side of the bed frame 1. This forms an air chamber 24, defined by the bed frame 1, the bottom bed board 2, and the upper bed board 3. The separating board 14 divides the air chamber 24, forming a small chamber 15. The separating board 14 has two through holes 16 for air to flow through from the small chamber 15 to the air chamber 24 or vice versa. The small chamber 15 also contains a foot swayer 103. Further, a small through hole 13 is provided in one side of the frame body 1 for fixing an air adjusting valve 72 of the massage bar 9 therein. Further, the bed frame 1 has four legs 10 supported by four elastic feet 19.

Figure 3:
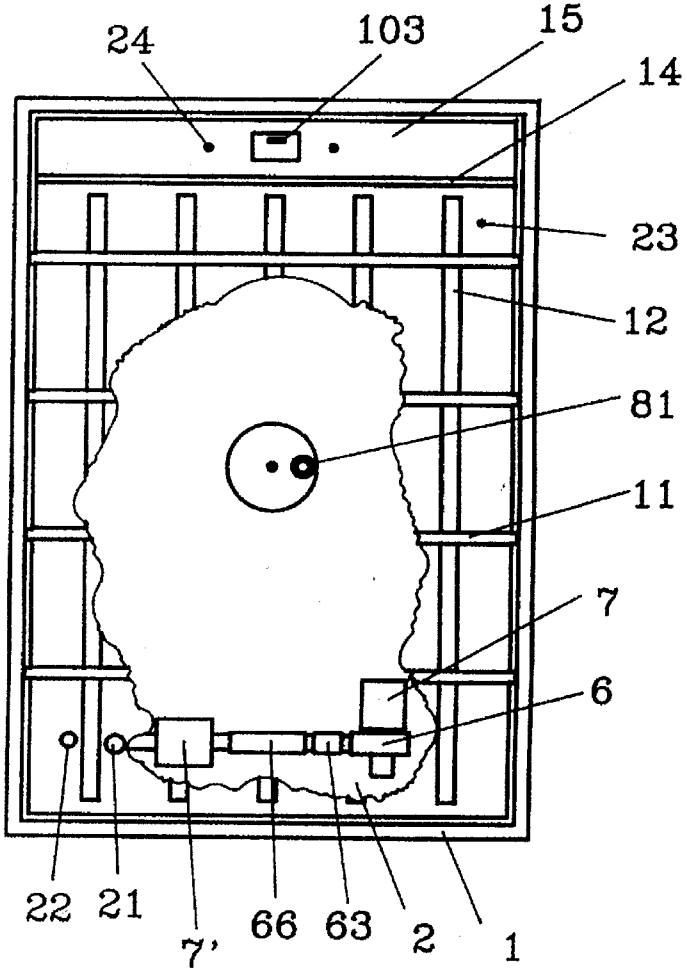
FIG. 3 is an upper view of the multi-function healthful bed of the present invention.

The bottom bed board 2, as shown in FIGS. 1 and 3, is closely placed on and connected to the bottom edge of the bed frame 1. The bottom bed board 2 has a large through hole 21 near the center of the lower side connected to an air tube 64 of the blower 6. A small through hole 22 beside the large through hole 21 is connected to a tube of an air conditioner. An air exit 23 is in an upper portion of the bottom bed board 2. The bottom bed board 2, the upper bed board 3, and the bed frame 1 form the air chamber 24 and the small chamber 15 to contain air. The air in the air chamber 24 may be cooled by cool air coming from an air conditioner or warmed by warm air coming from a heater 65. The cool or warm air in the air chamber 24 may be exhausted through the air exit 23 when the air in the chamber 24 becomes saturated. Cooled or warmed air in the air chamber 24 may flow into the small chamber 15 through the holes 16 for the foot swayer 103, and flow out of two exit holes 25.

Figure 18:
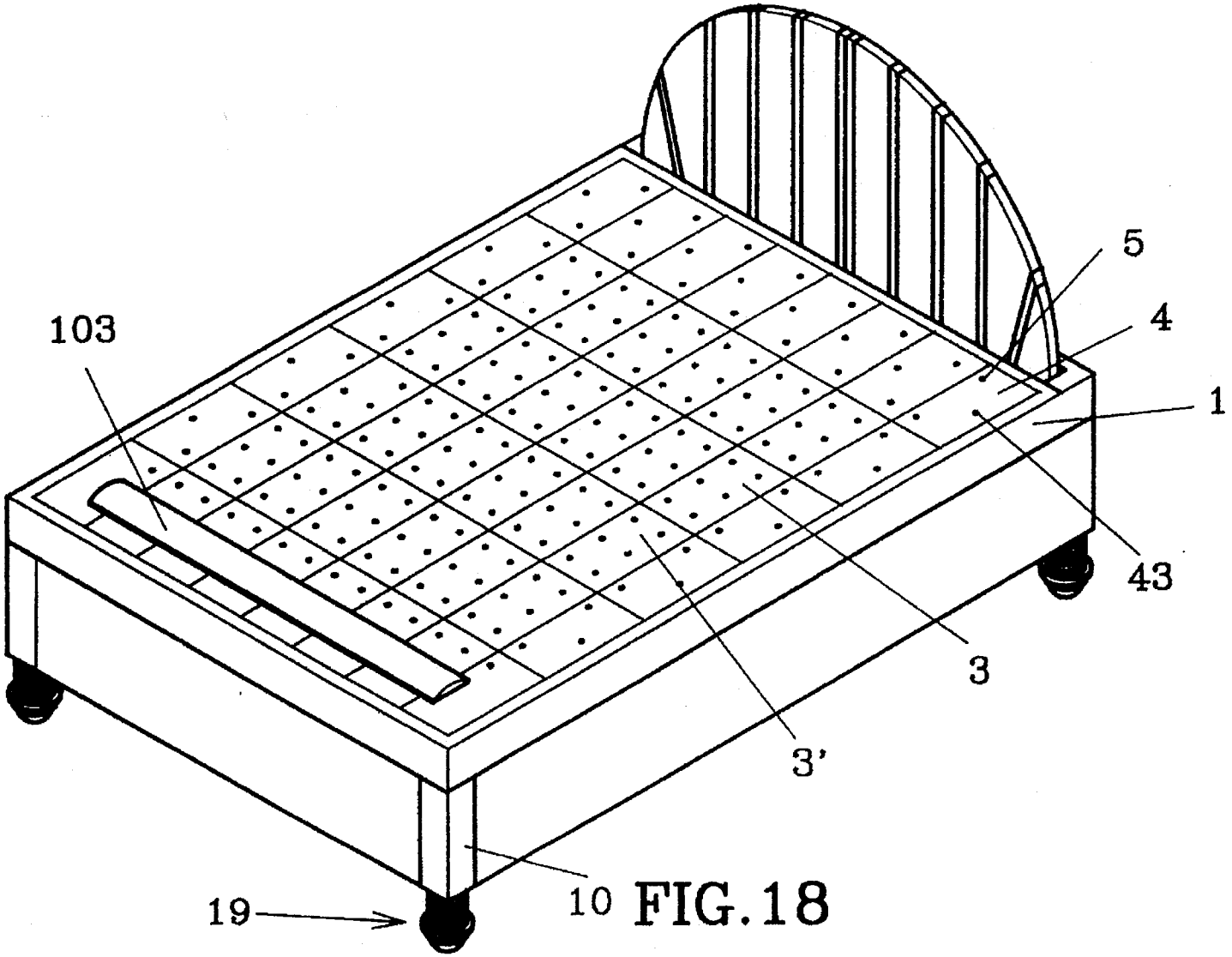
FIG. 18 is a perspective view of the multi-function healthful bed of the present invention.

The upper bed board 3 consists of a plurality of upper small bed boards 3' shown in FIGS. 1 and 18, and four upper small corner bed boards 4, all arranged on the four upper lateral bars 11. Each upper small bed board 3' has a plurality of threaded holes 31 spaced apart for fixing air valves 5 therein from below.

Figure 9:
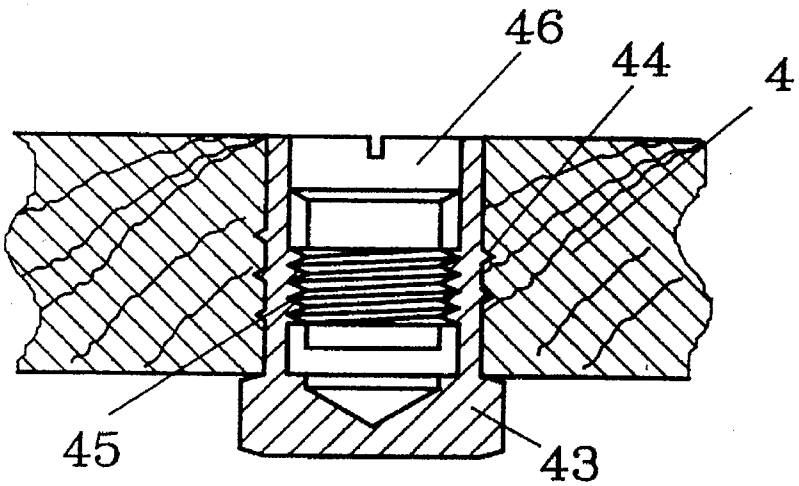
FIG. 9 is a side cross-sectional view of the bolt of the multi-function healthful bed of the present invention.
Figure 8:
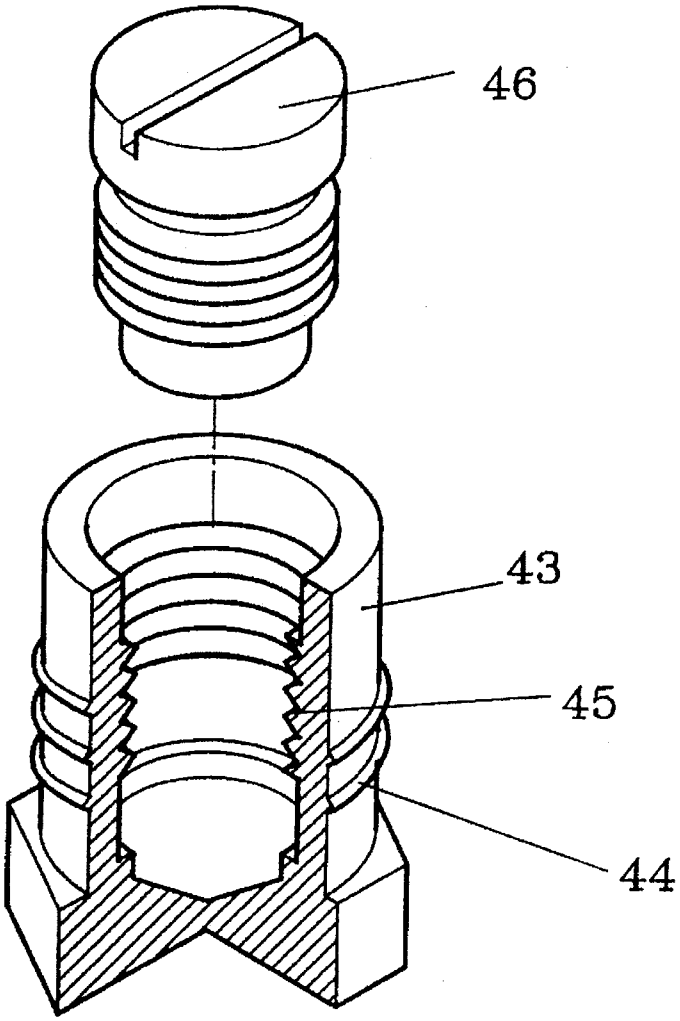
FIG. 8 is an exploded perspective view of a bolt of the multi-function healthful bed of the present invention.
Figure 11:
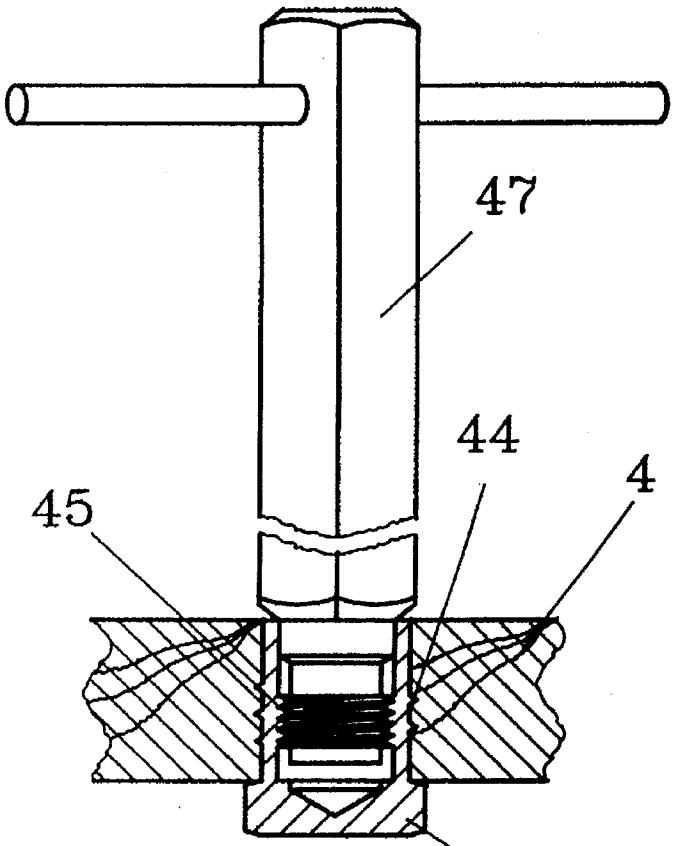
FIG. 11 is a side cross-sectional view of the bolt and the spanner engaging with the bolt of the present invention.
Figure 10:
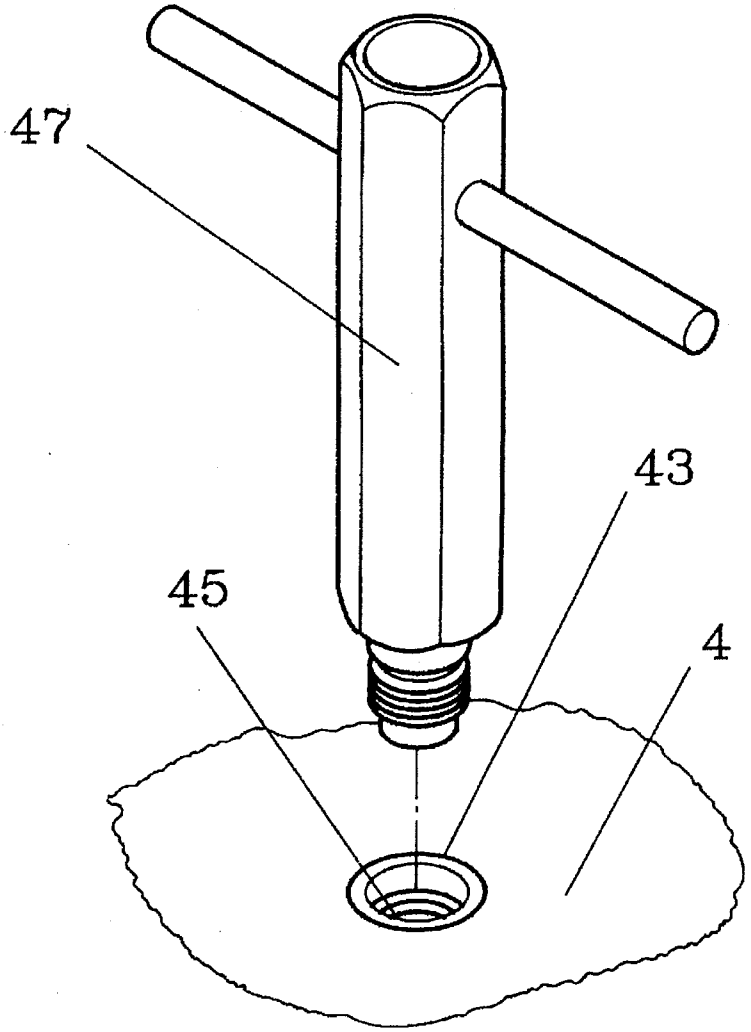
FIG. 10 is a perspective view of the bolt and a spanner of the multi-function healthful bed of the present invention.
Figure 12:
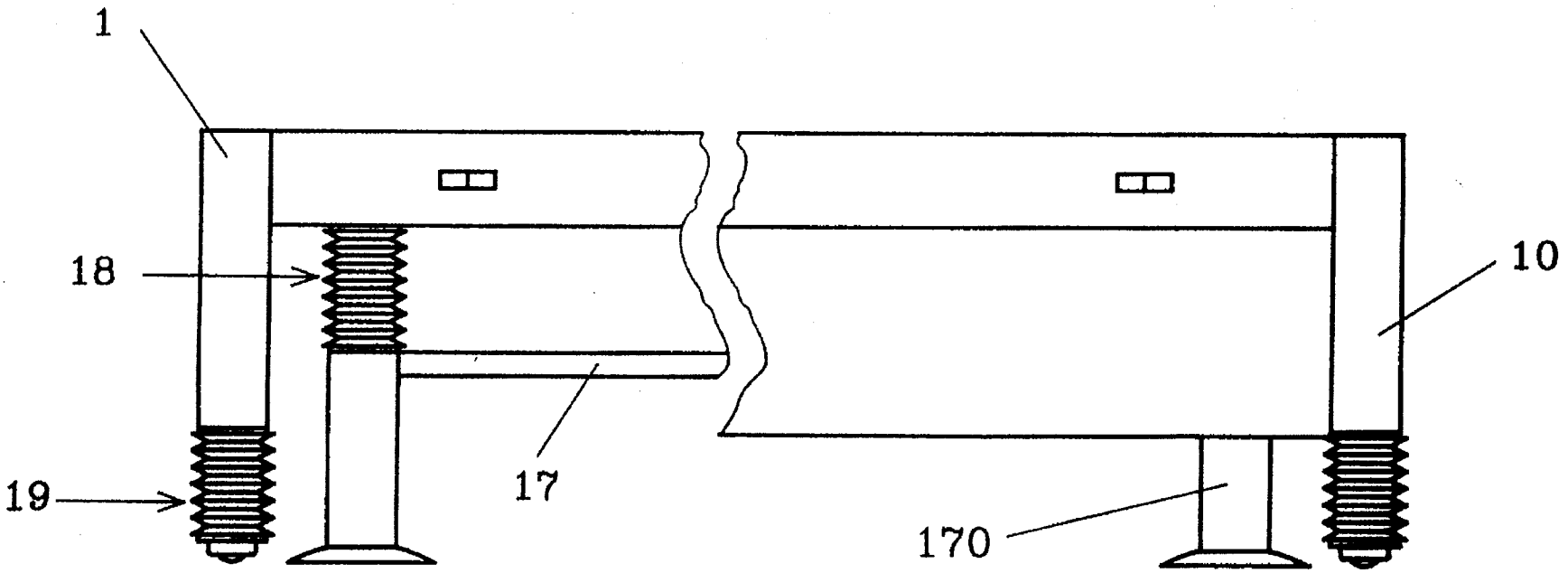
FIG. 12 is a front view of a bed frame and a bottom bed board combined.

The four upper small corner bed boards 4, as shown in FIGS. 1 and 18, are placed at four inner corners of the bed frame 1, abutting the upper small bed boards 3'. The corner bed boards 4 have several threaded holes 41 for fixing the air valves 5 therein from below, and a hole 42 beside one of the threaded holes 41 for a bolt 43 to engage from below. The bolt 43 has a male thread 44 to engage with the hole 42 and a female thread 45 for engaging a nut 46 as shown in FIGS. 8 and 9, or for a spanner 47 to engage as shown in FIGS. 10 and 11. The nut 46 is flush with the upper surface of the upper bed board 3.

Figure 4:
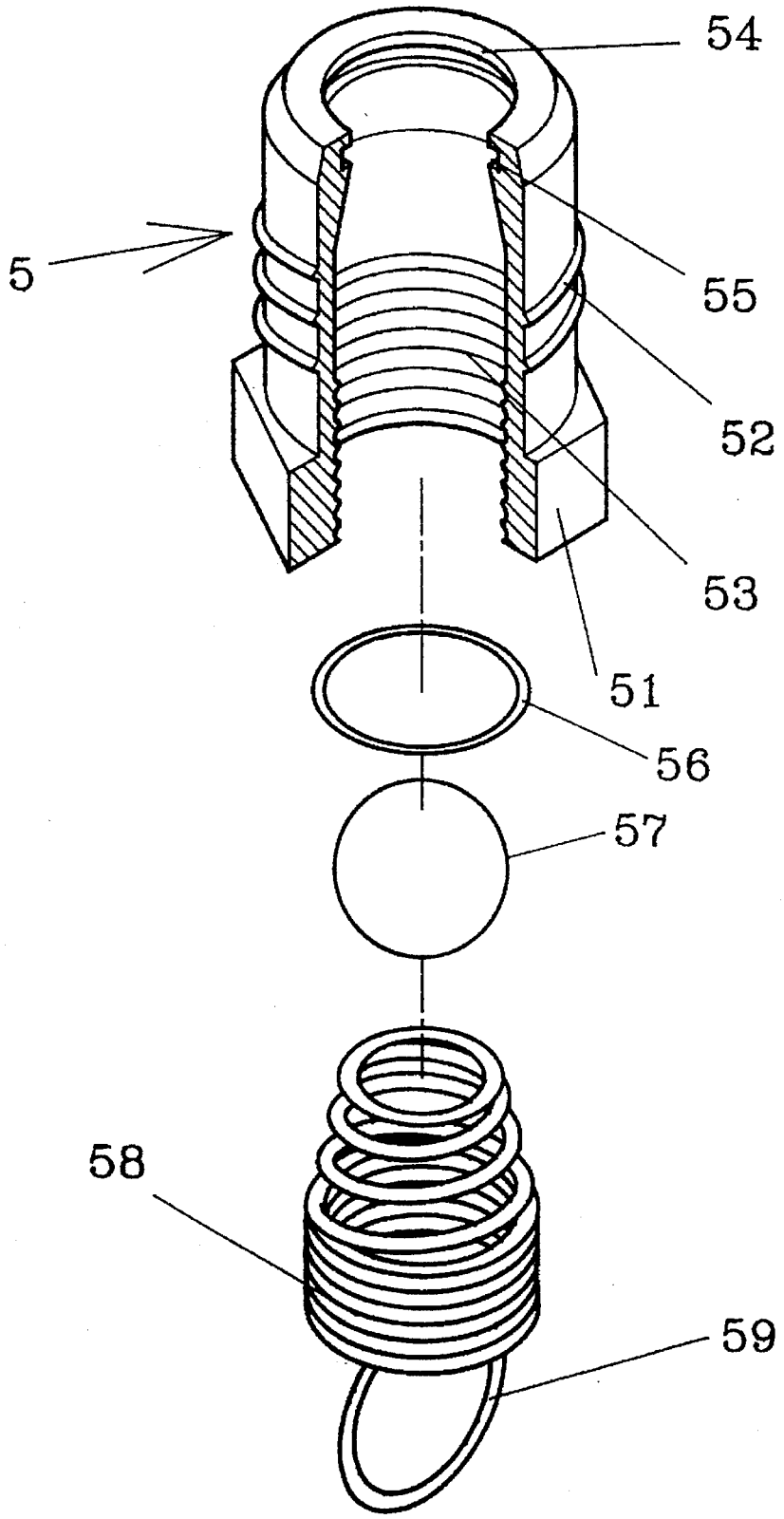
FIG. 4 is an exploded perspective view of an air valve of the multi-function healthful bed of the present invention.
Figure 6:
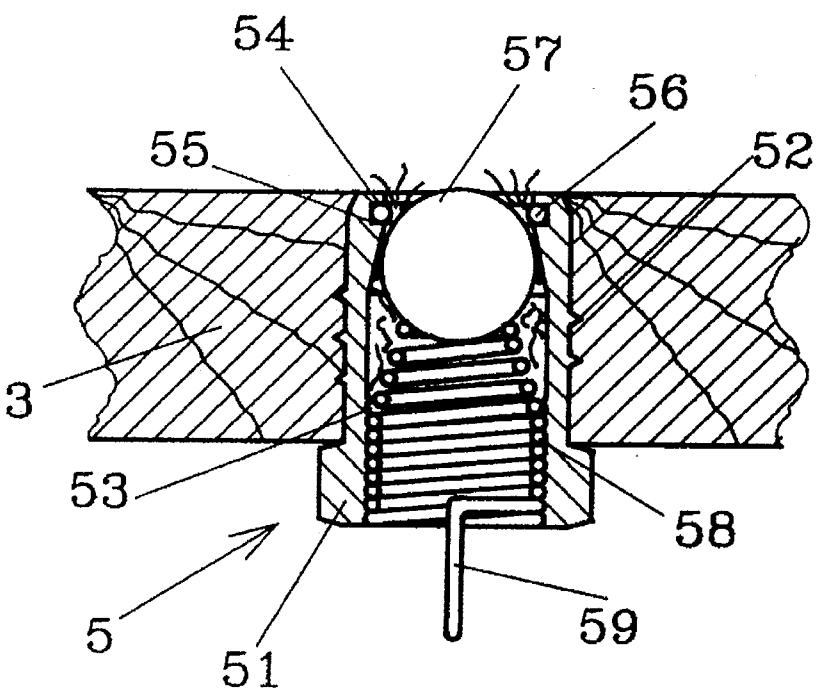
FIG. 6 is a side cross-sectional view of the air valve of the multi-function healthful bed of the present invention, showing it in the closed state.
Figure 5:
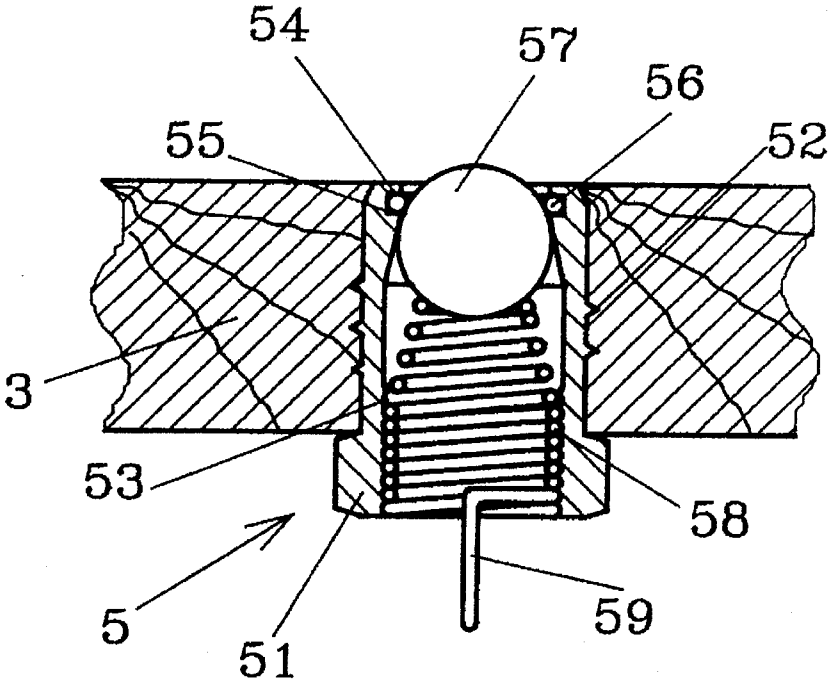
FIG. 5 is a side cross-sectional view of the air valve of the multi-function healthful bed of the present invention.

The air valves 5, as shown in FIGS. 4,, and 6, have a cylindrical portion 51, an annular gasket 56, a ball 57 and a spring 58 as their chief components. The cylindrical portion 51 has a male thread 52 to engage a threaded hole 31 of the upper small bed board 3' or a threaded hole 41 of a small corner bed board 4 or a threaded hole 82 of the massage bar 9. The cylindrical portion 51 further includes a female thread 53, a projecting-inward annular edge 54, and an annular groove 55 below the annular edge 54 to receive an annular gasket 56. The ball 57 is inserted into the cylindrical portion 51 from below reaching to contact the annular gasket 56 urged by the part helical and part round spring 58. The spring 58 engages with the female thread 53 so as to secure the ball 57 in its position. The spring 58 further has a projecting-down ring 59 at a lower end to rotate the spring 58 itself.

The blower 6, as shown FIG. 1, is mounted on a support plate 17 with four corner feet 170 below the bottom bed board 2. The blower has an air exit 61 at a front end, a short tube 63 connected to the air exit 61, and an air tube 64 connected with the short tube 63. The air tube 64 contains a heater 65 with an insulating fiber 66 wound around an outer surface of the air tube 64. The outer end of the air tube 64 is connected with the large hole 21 of the bottom bed board 2. The blower 6 further has an air inlet 62 connected to a first muffler 7.

Figure 2:
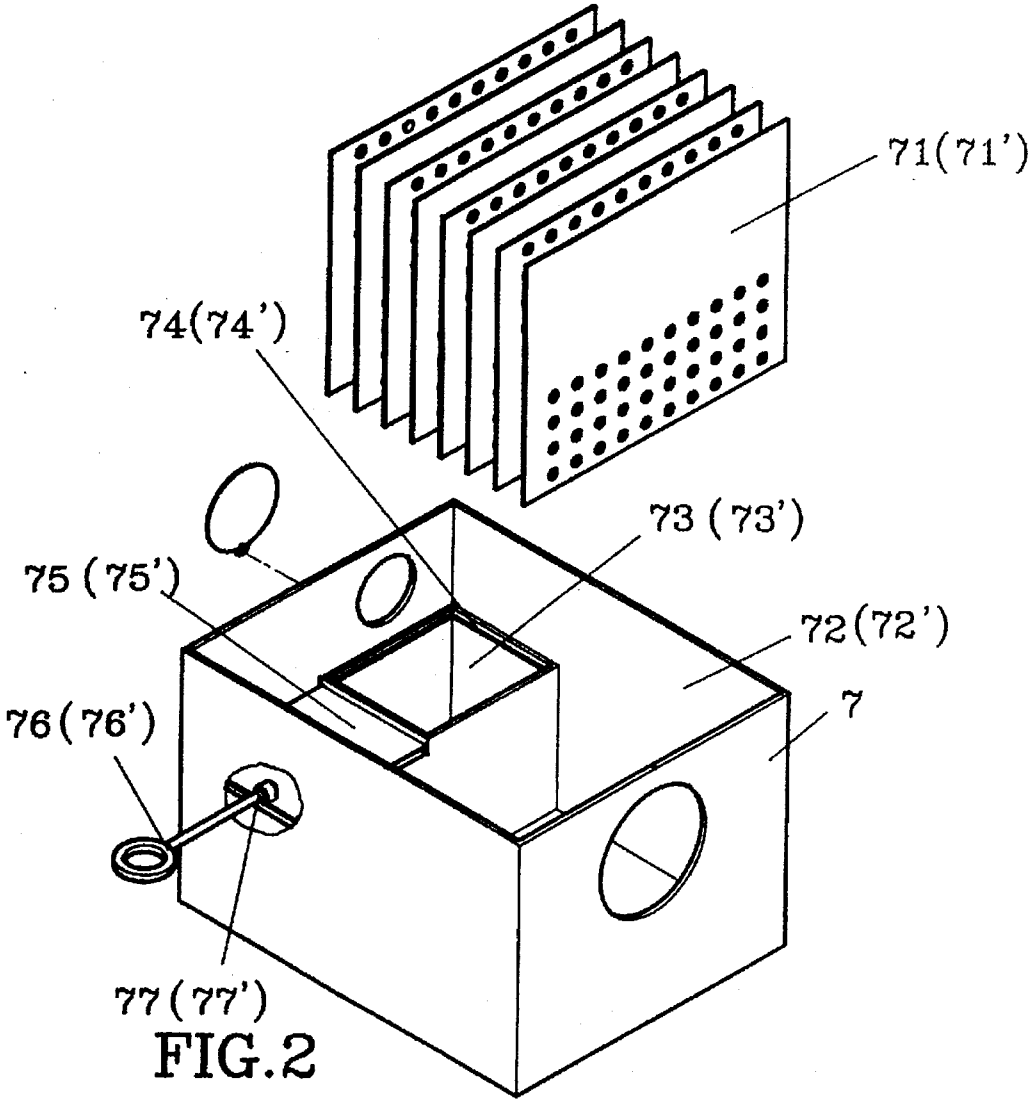
FIG. 2 is an exploded perspective view of a muffler of the multi-function healthful bed of the present invention.

The two mufflers—a first one 7 and a second one 7'—as shown in FIGS. 1 and 2, are mounted on the support plate 17. The muffler is box-shaped, and has a muffling chamber 72, 72' separated with a plurality of separating plates 71, 71' vertically set therein. A water chamber 73, 73' has an annular groove 74, 74' in an upper inner end. A water gate 75, 75' is movable to engage the annular groove 74, 74' and is connected to a handling rod 76, 76' extending laterally out of a wall hole 77, 77' of the mufflers 7, 7' for opening or closing the water gate 75, 75'. The first muffler 7 is connected to the air inlet 62 of the blower 6, and the second muffler 7' is connected to the air tube 64 and to the large hole 21 of the bottom end board 2 via a soft tube 78.

The eccentric motor 8 is for swaying the bottom end board 2 together with the bed frame 1, and is also mounted on the support plate 17. The motor 8 is connected with the bottom center of the bottom end board 2, and has an eccentric bearing 81 fitted at its top. The bearing 81 is received in a round recess of a square plate 82, which is in turn fixed firmly with the bottom of the bottom end board 2. Thus, when the motor 8 rotates, the bottom end board 2 and the bed frame 1 are swayed by the square plate 82 engaged with the eccentric bearing 81 of the motor 8.

The support plate 17 is preferably rectangular or square, including four feet 170, which elevate the support plate 17. the feet 170 have a swayable rod 18 on top. (See FIG. 12.)

Figure 14:
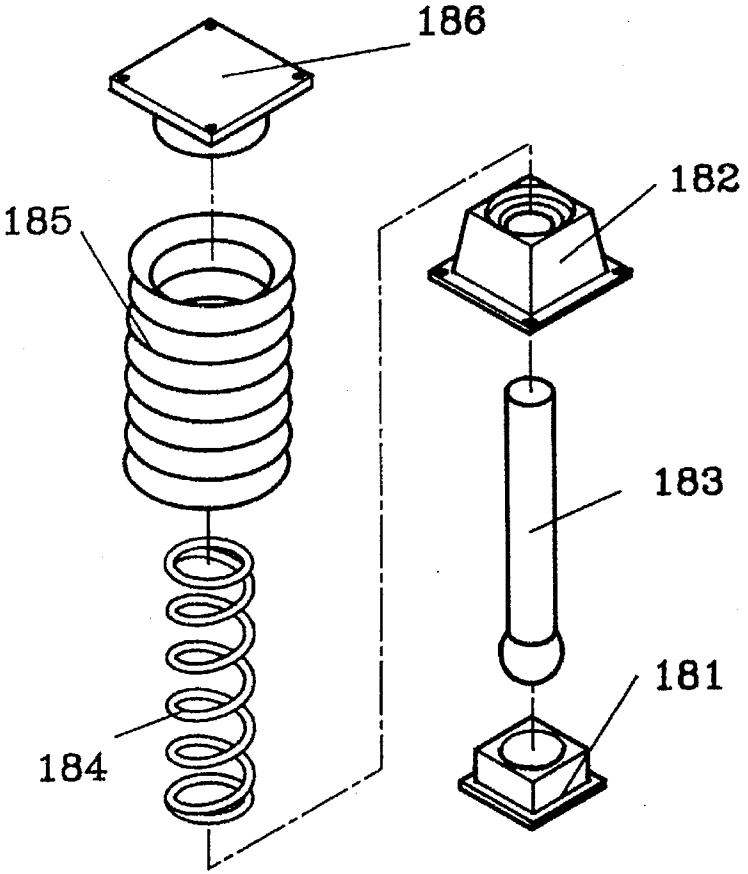
FIG. 14 is a side view of the support rod of the multi-function healthful bed.
Figure 13:
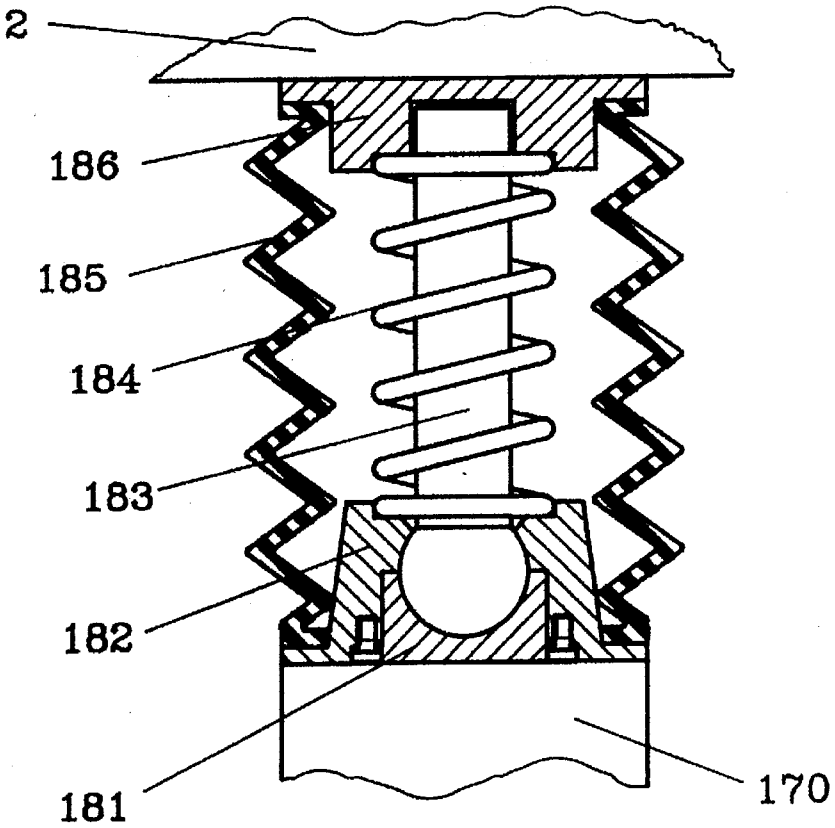
FIG. 13 is an exploded perspective view of a support rod of the multi-function healthful bed.
Figure 16:
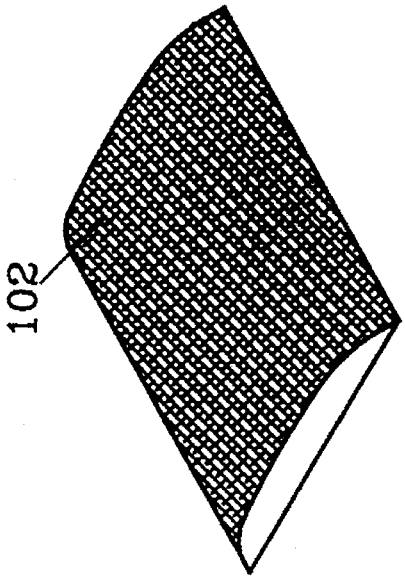
FIG. 16 is a perspective view of an air percolating board of the multi-function healthful bed of the present invention.

Referring now to FIGS. 13 and 14, the swayable rod 18 consists of a lower sustaining base 181 with a socket and an upper sustaining base 182 surrounding the lower sustaining base 181. A short rod 183 is provided with a spherical lower end to engage the lower sustaining base 181 and the upper sustaining base 182. A coil spring 184 fits around the short rod 183, with a bellow-like tube 185 fitting around the coil spring 185. An upper positioning plate 186 is provided with a center lower hole for the top of the short rod 183 to engage.

The swayable rods 18 are shown in FIGS. 1, 12, 13, and 14. The lower spherical end of the short rod 183 is combined with the upper sustaining base 182, and with the lower sustaining base 181 by means of screws. Next, the upper sustaining base 182 is fixed firmly on each of the four corner feet of the support plate 17 with screws. Then the coil spring 184 is placed around the short rod 183, and the bellow-like tube 185 is positioned between the upper sustaining base 182 and the upper positioning plate 186, housing the short rod 183 and the coil spring 184. The upper positioning plate 186 is fixed to the bottom bed board 2 with screws. Therefore the lower spherical end of the short rod 183 may move around in the upper and the lower sustaining bases 182 and 181 when each corner foot 170 of the support plate 17 is swayed by the bottom end board 2.

In addition, four elastic feet 19 are provided to support the four feet 10 of the bed frame 1. The feet 19 have a rollable means 191, a strong coil spring 192 having a lower end pushing the rollable means 191 and an upper end fitting in a center lower hole of an upper disc 193, and a bellow-like tube 194 housing a lower portion of the upper disc 193, an upper portion of the rollable means 191, and the coil spring 192. The upper disc 193 is secured firmly to each of the four feet of the bed frame 1 with screws. The four elastic feet 19 can support the bed frame 1 with free mobility.

Figure 7:
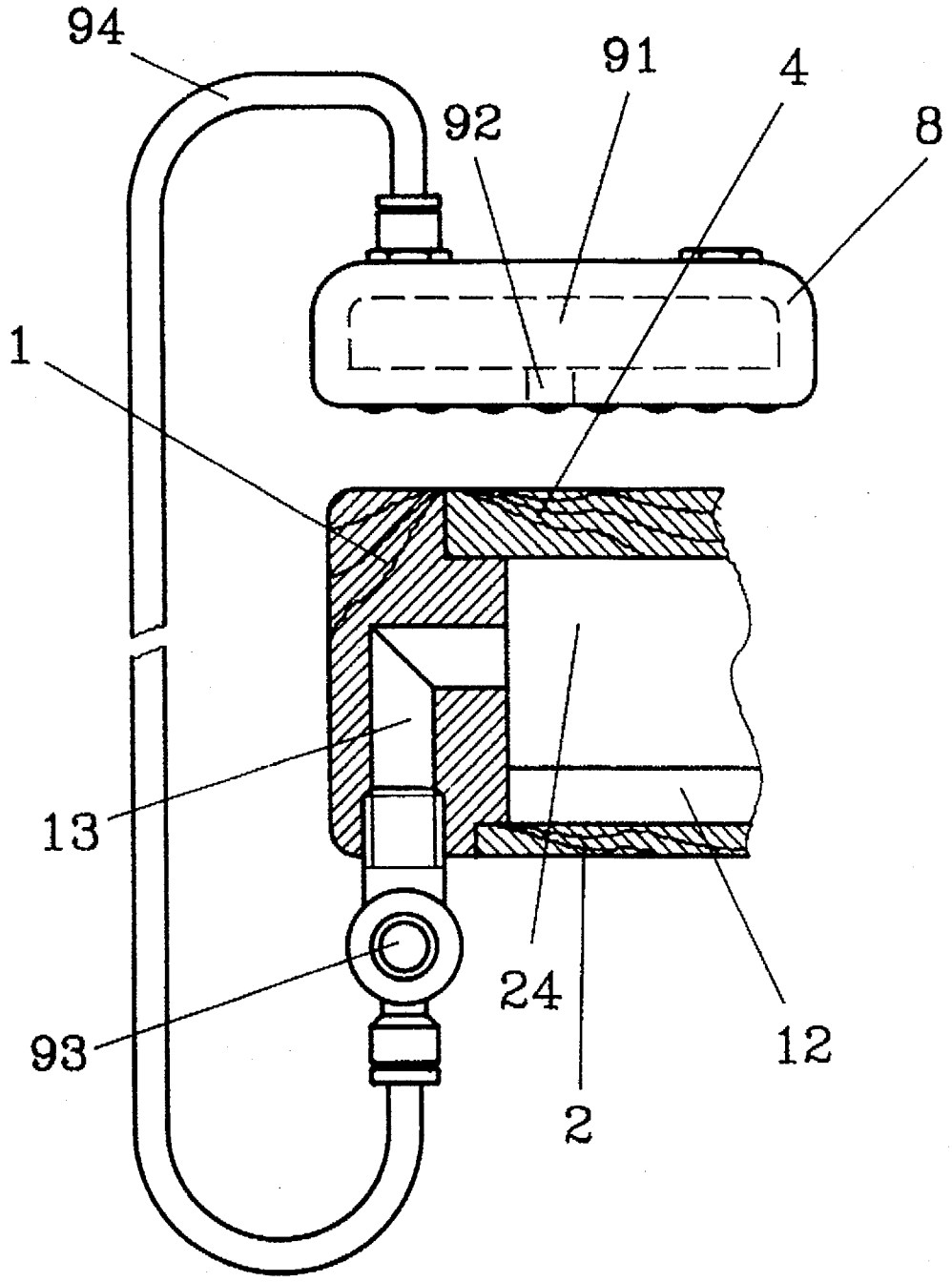
FIG. 7 is a side view of a massage bar of the multi-function healthful bed of the present invention.

The massage bar 9, as shown in FIG. 7, is for massaging. The bar 9 has a hollow interior 91 with a plurality of threaded holes 92 spaced apart in a bottom wall, with a like number of air valves 5 fixed in the threaded holes 92. A flexible air tube 94 is connected with an air adjusting valve 83, which is firmly fixed in the small hole 13 of the bottom bed board 1.

Figure 17:
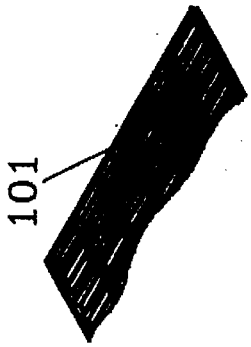
FIG. 17 is a perspective view of a pillow of the multi-function healthful bed of the present invention.
Figure 15:
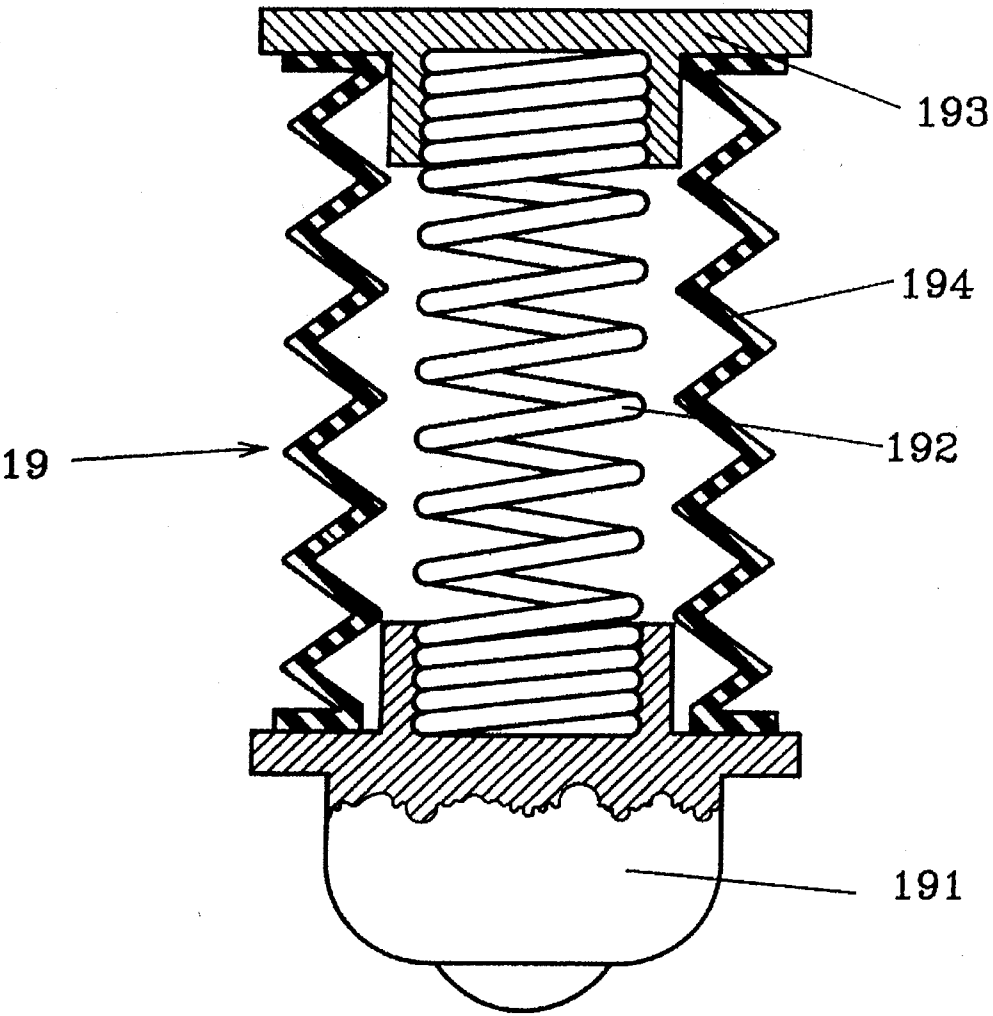
FIG. 15 is a side view of a spring cylinder of the multi-function healthful bed.

The percolating board 101 as shown in FIG. 17, is made of a net-holed board, and is located on an upper section of the upper bed board 3 and under a pillow 102. The percolating board 101 lightly touches the balls 57 of the air valves 5 of the upper section of the upper small bed boards 3'. The air valves 5 are opened to permit cooled or warmed air to pass through when the upper bed board 3 is pressed down by the weight of the body and the head of a person lying on the bed.

The pillow 102, as shown in FIG. 14, is made of a soft material, placed on the percolating board 101.

The foot swayer 103, as shown in FIGS. 1 and 18, is a well-known conventional item, and is not described in detail here. The swayer 103 is laid in the small chamber 15.

Operation of the multi-function healthful bed of the present invention is as follows: When the weather is cool and the bed has to be warmed, the water gate 75 of the muffler 7 is opened, and the heater 65 is powered to warm up the air in the air tube 64. The heated air is then sent into the air chamber 24 by the blower 6. As the balls 57 of the air valves 5 located in the upper small bed boards 3' and the upper corner bed boards 4 are pressed down by a person lying on the bed, the valves 5 are opened to allow the warmed air in the air chamber 24 to flow therethrough and to flow around and warm the body of the user.

If the weather is hot, and the bed needs to be cooled, the heater 65 and the blower 6 are turned off, and an air conditioner used to produce cooled air. The cooled air is be sent through the hole 22 in the bottom bed board 2 and then into the air chamber 24. Therefore, the cooled air in the air chamber 24 can be allowed to flow through the air valves 5 of the upper small bed boards 3' and the upper small corner bed boards 4 in the same way as described above, flowing around the body of the user.

If the user wants to massage his body, the massage bar 9 connected with the hole 13 of the bed frame 1 is held by hand. The bottom side if the massage bar 9 is pressed against the body of the user. Air valves 5 are simultaneously opened to let air flow out of the air chamber 24 to flow around the body of the user.

When the user desires the whole bed to sway, the eccentric motor 8 is started by activating a switch, and the whole bed will begin to sway by means of the eccentric motor 8 in conjunction with the four swayable rods 18.

If the upper bed board 3 is to be taken off, the nuts 46 of the bolts 43 in the upper small corner bed boards 4 are screwed off, and the spanner 47 is used to engage and pull the four upper small corner bed boards 4 off the upper small bed boards 3'. Then the upper small bed boards 3' can be easily taken off.

While the preferred embodiment of the invention has been described above, it will be recognized and understood that various modifications may be made therein and the appended claims are intended to cover all such modifications which may fall in the spirit and scope of the invention.

What is claimed is:

1. A multi-function healthful bed comprising:

a bed frame having a bottom edge connected to a bottom bed board, four longitudinal bars are contained in a space defined by said bed frame, four upper lateral bars are located on said four longitudinal bars, a separating lateral elongate board is situated parallel to said four upper lateral bars near a first side of said bed frame, and a small hole in a first side of said bed frame to receive an air adjusting valve for a massage bar;

a bottom bed board connected to a bottom edge of said bed frame, said bottom bed board includes a large hole in a front portion of said bottom bed board to receive an air tube of a blower, said bottom bed board further includes an air hole to receive an air tube from an air conditioner, said bottom bed board further includes an exhaust air hole to exhaust saturated air from an air chamber defined by said bottom board, an upper bed board, and said bed frame;

said upper bed board comprises a plurality of small bed boards and four small corner bed boards situated on said four lateral bars of said bed frame, each said small bed board having a plurality of threaded holes to receive air valves;

said four upper small corner bed boards are located at corners of said upper bed board on said lateral bars, each said corner upper small bed board has a plurality of threaded holes to receive air exit valves for fixing air exit valves therein and a bolt hole to receive a bolt, said bolt having a center through hole with a female thread for a nut and for a spanner to engage;

a support plate located below said bottom bed board, said support plate has four corner feet to elevate said support plate, said support plate receiving a blower, two mufflers and an eccentric motor thereon;

four swayable rods located on said corner feet of said support plate to support said bottom bed board and said bed frame, said swayable rods comprising a lower and an upper sustaining base, a short rod, a coil spring, a bellow-like tube, and an upper positioning disc, said lower sustaining base is located on said corner foot and has an upward semicircular depression, said upper sustaining base is located on said lower sustaining base and has a curved through groove, said short rod has a lower spherical end to movably engage said lower sustaining base and said upper sustaining base, a top of said short rod engages a center hole of said upper positioning disc;

elastic feet supporting each of said four feet of said bed frame, each of said elastic feet includes a rollable means, a strong coil spring, an upper positioning disc and a bellow-like tube; said rollable means includes an upper center recess to receive a lower end of said coil spring, said elastic feet thereby elastically supporting said bottom bed board and said bed frame;

a plurality of air valves comprising a cylindrical portion with a male thread, an annular gasket, a ball, and a spring; said male thread of said cylindrical portion engages one of said threaded holes of said upper small bed board or one of said threaded holes of said upper small corner bed board or one of a plurality of threaded holes in said massage bar, said cylindrical portion further includes a female thread, an upper annular edge, and an annular groove under said upper annular edge to receive an annular gasket therein, said spring includes an upper helical portion, a lower round portion, and a vertical lower ring portion;

said blower includes an air exit connected an air tube connected to said large hole of said bottom board, and an air inlet connected to a first one of said two mufflers, said air tube includes an electric heater in an interior thereof and an insulating fiber wound around an outer surface;

said two mufflers each include a muffling chamber with a plurality of separating plates therein, a water chamber to store water, said water chamber has a groove in an upper inner wall to receive a water plate gate, said water plate gate has a lateral rod extending through a hole in one wall so as to push and pull said water plate gate into and out of said gate groove to open and close said water chamber, said first muffler is connected to said air inlet of said blower, a second one of said mufflers is connected to said air tube and to said large hole of said bottom bed board via a soft tube;

said eccentric motor is connected to a bottom center of said bottom bed board, said eccentric motor includes an eccentric bearing located in a round recess of a square plate that is secured firmly to a bottom of said bottom bed board, said eccentric bearing slides in said round recess of said square plate, thereby swaying said bottom bed board together with said bed frame when said eccentric motor rotates;

said massage bar has an air chamber inside and is connected to a flexible air tube connected to an air adjustable valve fixed in said hole in said bed frame;

an air percolating plate formed from a net-holed plate and situated on said upper bed board under a pillow, said air percolating plate receives the weight of a user of said bed and contacts and compresses said air valves of said upper bed board;

a foot swayer is contained in a small chamber of said air chamber, said small chamber is formed by said lateral elongate board dividing said air chamber; and heated air is pumped into said air chamber when warming of said bed is desired, and cooled air is pumped into said air chamber when cooling of said bed is desired, when said user lies on said bed, said air valves in said upper bed board are opened to allow said air in said air chamber to flow around said user.

* * * * *